US008161579B2

(12) United States Patent
Denkewicz, Jr. et al.

(10) Patent No.: US 8,161,579 B2
(45) Date of Patent: Apr. 24, 2012

(54) TOILET TANK MOUNTED ODOR ELIMINATOR

(75) Inventors: Raymond P. Denkewicz, Jr., East Greenwich, RI (US); Rolf Engelhard, Prescott, AZ (US)

(73) Assignee: Zuvo Water, LLC, Mountain View, CA (US)

( * ) Notice: Subject to any disclaimer, the term of this patent is extended or adjusted under 35 U.S.C. 154(b) by 1441 days.

(21) Appl. No.: 11/686,224

(22) Filed: Mar. 14, 2007

(65) Prior Publication Data

US 2007/0234469 A1 Oct. 11, 2007

Related U.S. Application Data

(60) Provisional application No. 60/782,467, filed on Mar. 15, 2006.

(51) Int. Cl.

| | |
|---|---|
| ***E03D 9/04*** | (2006.01) |
| ***E03D 9/02*** | (2006.01) |
| ***E03D 9/00*** | (2006.01) |
| ***E03F 5/08*** | (2006.01) |

(52) U.S. Cl. ..... 4/213; 4/216; 4/220; 4/222; 4/227.1; 4/228.1

(58) Field of Classification Search ..... 4/213, 216, 4/220, 227.1, 228.1

See application file for complete search history.

(56) References Cited

U.S. PATENT DOCUMENTS

| | | | | |
|---|---|---|---|---|
| 4,031,574 | A * | 6/1977 | Werner | 4/213 |
| 4,323,810 | A | 4/1982 | Horstmann | |
| 4,694,179 | A | 9/1987 | Lew | |
| 5,120,450 | A | 6/1992 | Stanley, Jr. | |
| 5,169,606 | A | 12/1992 | Batchelor | |
| 5,292,479 | A * | 3/1994 | Haraga et al. | 422/5 |
| 5,369,810 | A * | 12/1994 | Warren | 4/213 |
| 5,393,490 | A | 2/1995 | Jacob | |
| 5,573,733 | A | 11/1996 | Salama | |
| 5,942,196 | A | 8/1999 | Tabata et al. | |
| 5,961,920 | A * | 10/1999 | Soremark | 422/24 |
| 6,328,900 | B1 * | 12/2001 | King | 210/754 |
| 6,491,879 | B2 | 12/2002 | Conrad | |
| 6,511,594 | B2 | 1/2003 | Shaw | |
| 6,511,638 | B2 | 1/2003 | Matsuzaki | |

* cited by examiner

*Primary Examiner* — Len Tran
*Assistant Examiner* — Ryan Reis
(74) *Attorney, Agent, or Firm* — Mark J. Danielson; Pillsbury Winthrop Shaw Pittman LLP

(57) ABSTRACT

A self contained battery energized apparatus is mounted within the water tank of a conventional flush toilet to eliminate malodorous gases. Air from the toilet bowl is drawn through the stand pipe in the toilet tank into a housing to expose the air to UV radiation to produce ozone molecules that have an oxidizing effect on organic matter and the UV radiation serves as a germicide and a virucide. The ozonated and oxidized gases are exhausted through a carbon filter.

47 Claims, 7 Drawing Sheets

TOILET TANK MOUNTED ODOR ELIMINATOR

CROSS REFERENCE TO RELATED APPLICATIONS

The present application is related to and claims priority of a provisional application entitled "TOILET TANK MOUNTED ODOR ELIMINATOR", filed Mar. 15, 2006, and assigned Ser. No. 60/782,467, disclosing an invention by the present inventors.

BACKGROUND OF THE INVENTION

1. Field of the Invention

The present invention relates to apparatus for removing odors from toilet bowls and, more particularly, to apparatus for subjecting gases attendant a toilet bowl to ultraviolet radiation and ozone.

2. Description of Related Prior Art

Conventional flushing toilet bowls used throughout the world release odorous gases into the room upon use. A common solution to this problem is actuation of an exhaust fan to exhaust air and gases from the room through a ceiling mounted exhaust fan. Such exhaust fans may also be located in the walls of the room. These exhaust fans cause odorous gases to flow around and about an occupant and his/her clothing and some of the gases may permeate such clothing and hair of the user with socially unacceptable results. Moreover, the odorous gases are almost never exhausted completely by the time a user opens the door and some of the gases migrate therethrough into an adjoining area.

One of the most unpleasant effects of odorous gases is that a subsequent user of a toilet is often subjected to the presence of the gases which emanated from a previous user.

When a conventional toilet is flushed. A fine mist or aerosol is often created. Such a mist or aerosol will contain potentially harmful bacteria and viruses that will migrate throughout the adjacent area. This creates a potential health hazard to a subsequent occupant entering or within the adjacent area. Test results indicate that such a mist or aerosol may be present for up to two hours.

SUMMARY OF THE INVENTION

In an initial phase of use of a conventional flush toilet incorporating the present invention, air from the toilet bowl is drawn through a stand pipe within a water tank and irradiated by an ultraviolet lamp. Such irradiation has the beneficial effect of killing bacteria/viruses and producing ozone which has a tendency to oxidize organic material. Thereby, odors generated will be essentially destroyed. During the flush phase, water from a fill tube may be entrained with ozone or another water treatment element may also be incorporated. Air may be simultaneously drawn from the toilet bowl through the stand pipe and passed across the ultraviolet lamp with the above-noted beneficial effects and exhausted through a carbon filter. To render the apparatus essentially self contained, it may be mounted within the toilet tank and elements thereof are battery operated to avoid any electrical hazard. A local or remote switch may be used to initiate operation and thereafter function automatically or each step may be manually energized and de-energized.

It is therefore a primary object of the present invention to provide a self contained apparatus for eliminating odors attendant a toilet bowl.

Another object of the present invention is to provide a self contained apparatus mountable within a conventional water tank of a flush toilet that eliminates odors emanating from the toilet bowl.

Yet another object of the present invention is to provide apparatus removably mounted within a conventional water tank of a flush toilet that irradiates and ozonates gases drawn from a toilet bowl.

Still another object of the present invention is to provide an add-on apparatus for any conventional flush toilet that will eliminate odors generated during use of the toilet.

A further object of the present invention is to provide a method for eliminating odors emanating from a toilet bowl.

A yet further object of the present invention is to provide a method for irradiating and ozonating gases generated within a toilet bowl during use with apparatus contained within a toilet water tank.

A still further object of the present invention is to provide a method for using a self contained toilet water tank mounted apparatus for eliminating odors emanating from a toilet bowl.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1A:
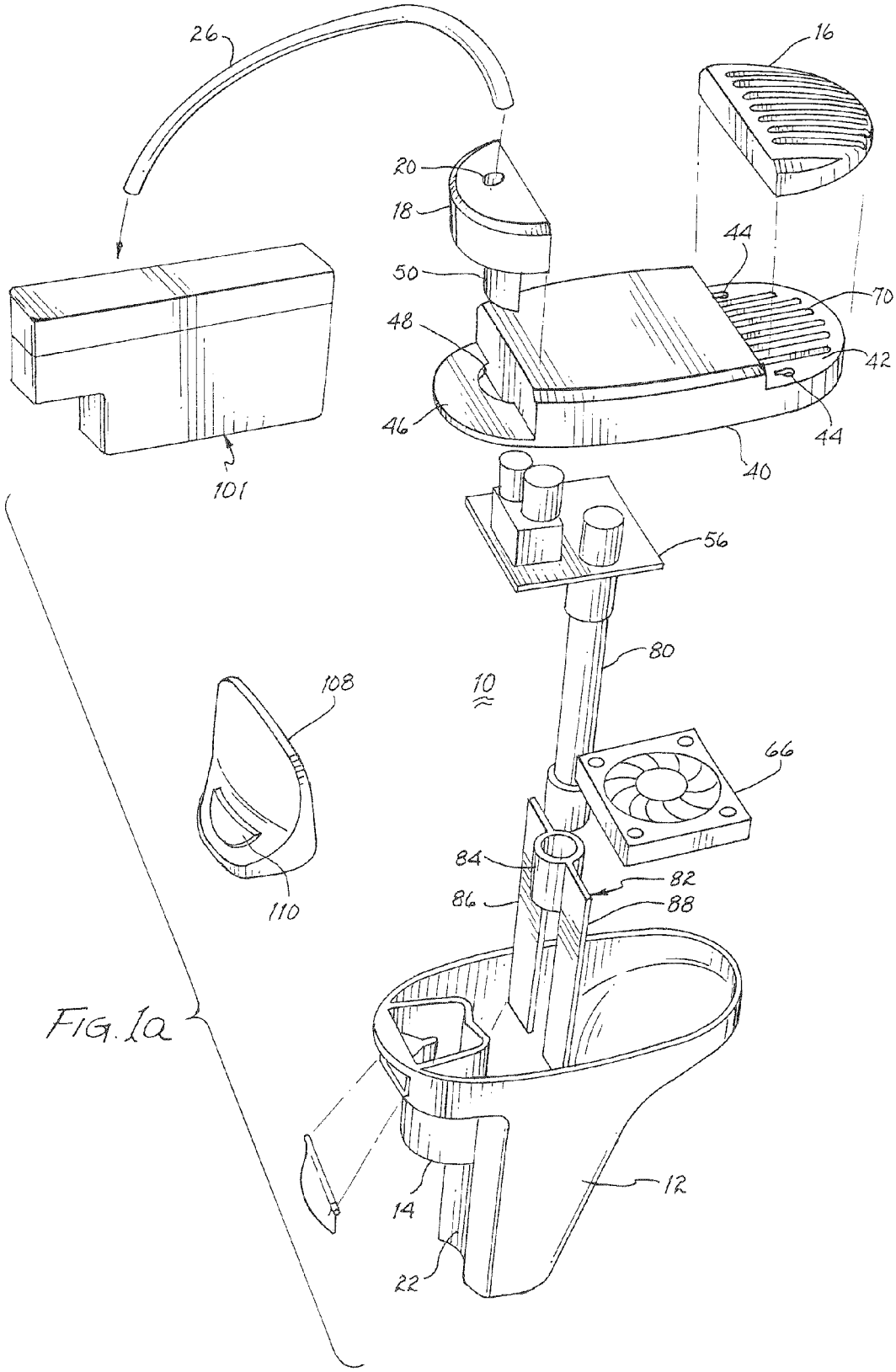
FIG. 1*a* is an exploded view of the major components of the odor eliminator shown in FIG. 1.
Figure 1:
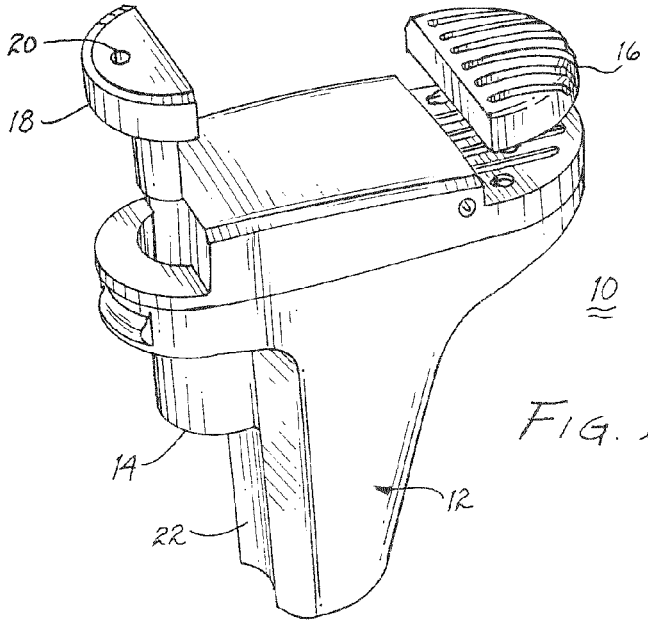
FIG. 1 illustrates a representative view of an odor eliminator mountable within the water tank of a conventional flush toilet.

FIG. 1 illustrates a self contained odor eliminator hereinafter referred to as unit 10. The unit includes a housing 12 having a downwardly opening cylinder 14 for receiving a conventional stand pipe mounted within a toilet water tank. A replaceable filter 16 may include a carbon mesh 17 for filtering the air exhausting from unit 10. An insert 18 includes a receiver 20 for engagement by a conventional fill tubing found within a toilet tank to provide a flow of water through the stand pipe during the flushing and fill cycles. While receiver 20 is illustrated as a cylindrical cavity, it may be a nipple for gripping engagement by the fill tubing. Support for unit 10 within the toilet tank is provided by the stand pipe in engagement with cylinder 14. It may be noted that a concave depression 22 may be incorporated to receive a length of the stand pipe and provide further stability to unit 10 when mounted on the stand pipe.

Referring jointly to FIGS. 1*a*, 2, 3 and 4, further details attendant unit 10 will be described. As particularly shown in FIG. 2, a conventional stand pipe 24 found in essentially every flush toilet is nestingly inserted within cylinder 14. It may bear against or be adjacent concave depression 22. Thereby, the stand pipe provides a mounting for and supports unit 10 within the water tank of a conventional flush toilet. During the flush and filling cycles of a conventional flush toilet, water flows through fill tubing 26 from a source of water. The fill tubing is inserted within receiver 20 and water from the fill tubing flows into insert 18 and through apertures 28 located in the lower end of the insert. The water flows from these apertures into cylinder 14 and stand pipe 24. This flow path is depicted by arrows 30.

Figure 2:
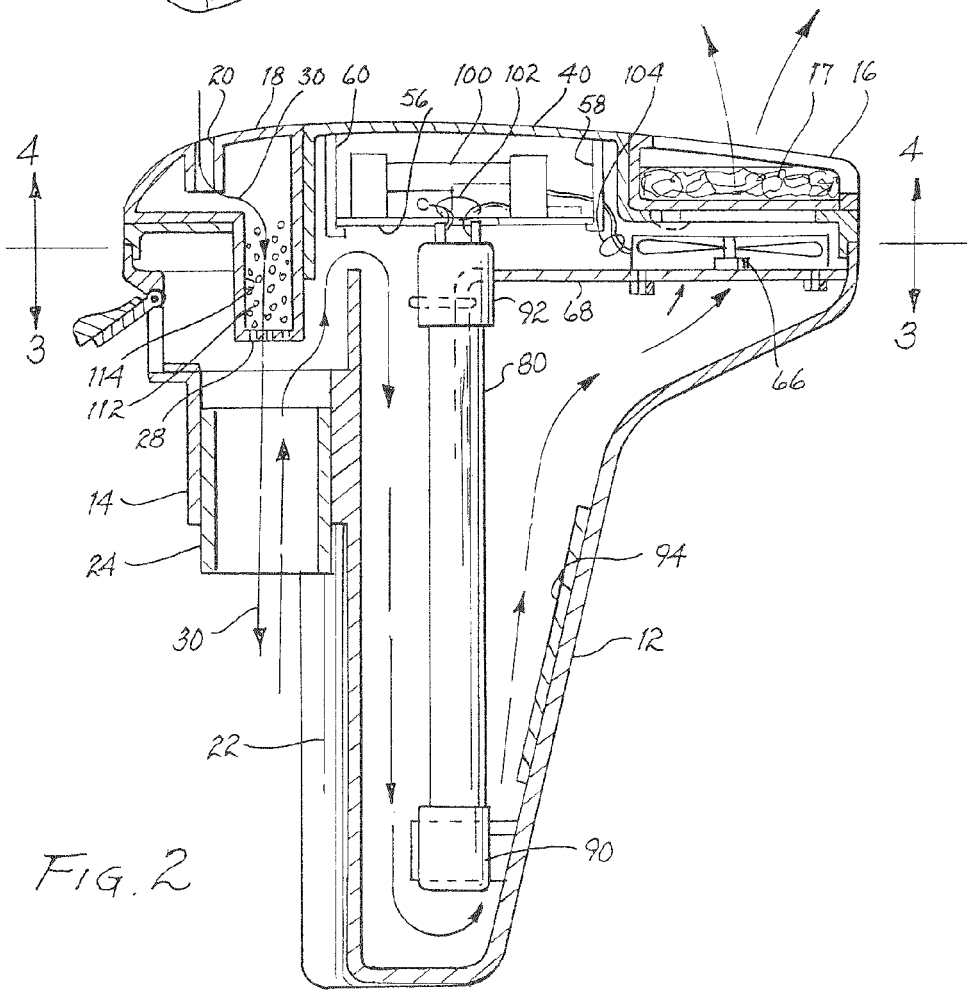
FIG. 2 illustrates a cross sectional view of the odor eliminator shown in FIG. 1.
Figure 3:
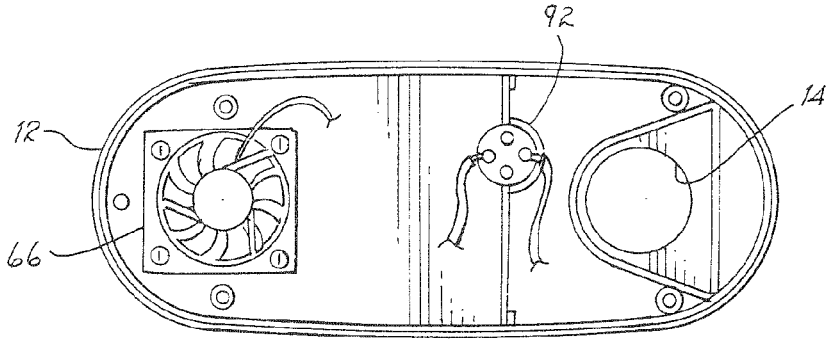
FIG. 3 illustrates is a cross sectional view taken along lines 3-3, as shown in FIG. 2.

A cap 40 is attached to the opening at the top of housing 12 and primarily supports the various electrical components necessary for unit 10 to perform its odor eliminating functions. The cap includes a recess 42 for receiving filter 16. Conventional key holes 44 may be disposed in the recess to mate with corresponding studs extending from filter 16. The cap also includes a platform 46 for supporting insert 18 and defining a passageway 48 for receiving hollow extension 50 of insert 18. A circuit board 56 is mounted within cap 40 to support the electronic circuitry necessary for operation of an enclosed ultraviolet (UV) lamp, fan and attendant switches. For example, downwardly extending stanchions 58, 60 may be used to support circuit board 56, as illustrated in FIG. 2. A fan unit 66 may be mounted on a platform 68 either attached to housing 12 or cap 40. The fan unit is juxtaposed with openings in recess 42, which may be slots 70, as illustrated. Thereby, operation of the fan unit will produce an airflow through the slots and filter 16. A UV lamp 80 is mounted within housing 12. The UV lamp may be mounted by any of several mechanisms. As shown in FIG. 1*a*, a bracket 82 includes a cylinder 84 for receiving and supporting the UV lamp. Side members 86, 88 extend from the cylinder into engagement with the interior of housing 12. The space between the side members accommodates placement of the UV lamp therebetween. Alternatively or in conjunction therewith, a cup shaped support 90 may be mounted within the lower end of housing 12 to support the depending end of the UV lamp. A further support 92, which may be in the nature of a socket to receive the prongs of the UV lamp, may be operatively associated with platform 68. To enhance the effect of UV radiation, a surface 94 reflecting UV light may be located within housing 12. A similar reflective surface may be embodied in the to be described variants of the invention.

Circuit board 56 not only supports the electronic circuitry necessary for operation of fan unit 66 and UV lamp 80 but also supports a battery 100 to provide the requisite electrical power for operating both the fan and the UV lamp. It is to be understood that an external battery 101 may be used. Such a battery may be of the type described in further detail with reference to battery 170 shown in FIGS. 6, 8 and 9. Necessarily, electrical conductors collectively identified by numeral 102 interconnect the electronic circuitry with the UV lamp and further electrical conductors 104 interconnect fan unit 66 with the electronic circuitry.

As shown in FIG. 1*a*, an electrical switch 108 may be used to control operation of unit 10. In the embodiment shown, the switch may be attached to the exterior surface of the toilet tank to render it readily accessible to a user. The switch may include a push button 110 to activate the switch. This switch, shown representatively, may be connected to the circuitry on circuit board 56 by electrical conductors. Preferably, a low power radio frequency transmitter and receiver (not shown) are embodied in the switch and the circuit board respectively, to provide the switching function and yet eliminate the presence of electrical conductors. It is to be understood that audible or inaudible sounds may be transmitted, as well as other forms and techniques for operatively interconnecting switch 108 with the electronic circuitry on circuit board 56.

Figure 4:
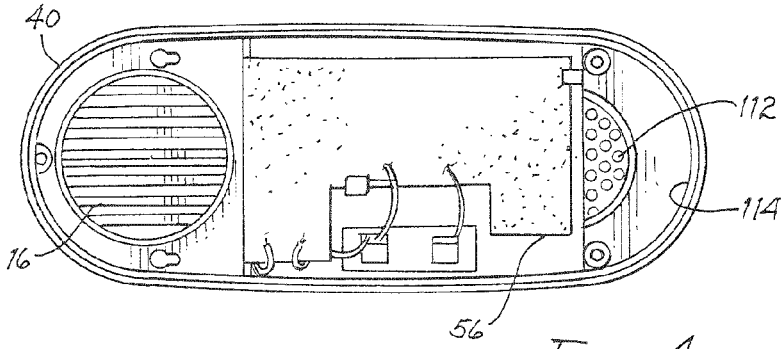
FIG. 4 is a cross sectional view taken along lines 4-4, as shown in FIG. 2.

Silver ions may be added to the toilet bowl water for continuous bacterial and viral inactivation. Silver ions are well-known to inactivate pathogenic microorganisms. Further, silver ions may be synergistic with ozone for microorganism destruction as has been found when silver is used in combination with strong oxidizers. Silver ions can be introduced into the water through various means. For example, a static bed 112 of resin impregnated with silver metal, silver ions or silver/copper ions may be disposed in compartment 114, as shown in FIGS. 2 and 4. Thereby, the water flowing into the toilet bowl is channeled through the items (static bed 112) disposed in compartment 14. The silver and silver/copper ions kill bacteria and viruses in the toilet water so aerosols created during the flush cycle are less infectious to others in the environment. The resin can be a polymer, ceramic or other inorganic substrate (e.g. Alumina). Activated carbon can be used as the silver support, however, ozone will be converted to oxygen in that case. Alternatively, an electrolytic cell may be employed for silver ionization. Such methodology is known in the art for dispensing silver (and copper or zinc) into drinking water or pool and spa water for purification purposes.

Figure 5A:
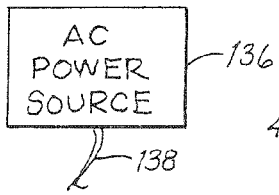
FIG. 5*a* illustrates an alternative power source.
Figure 5:
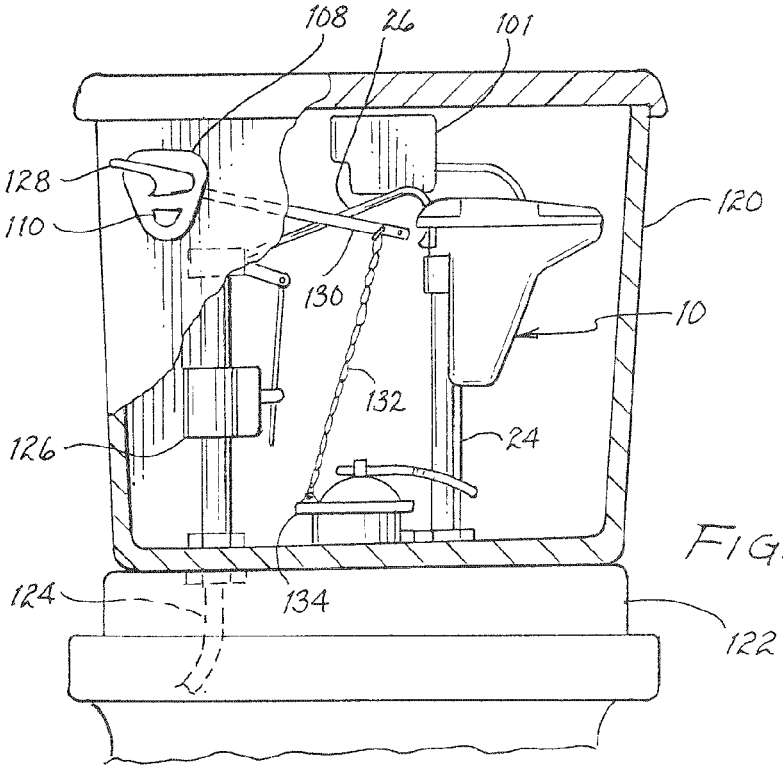
FIG. 5 illustrates partial cross sectional view of the odor eliminator mounted within the water tank of a conventional flush toilet.

Referring to FIG. 5, there is illustrated a representative water tank 120 located above a conventional flush toilet 122. A conduit 124 is connected a source of water under pressure to provide water to a conventional float valve 126. A handle 128 pivotally actuates a rod 130 supporting a chain 132 attached to a flapper valve 134. Upon actuation of handle 128, the flapper valve will open and the flush cycle of the toilet will commence. As the water level within the toilet tank drops, the float of the float valve will descend resulting the opening of a valve to permit an inflow of water from conduit 124. Simultaneously, water will flow through fill tubing 26 into unit 10. This inflowing water will flow through stand pipe 24 into the toilet bowl. The above-discussed switch 108 may be mounted in conjunction with handle 128, as illustrated. Thereby, a user can initiate operation of unit 10 by simply depressing push button 110 prior to or during use of the toilet. Activation of the push button will cause unit 10 to operate and draw air/gas through stand pipe 24 into the unit. The air channeled through unit 10 will be ozonated and filtered to purify any gases present and reduce the likelihood of migration of malodorous gases, viruses and bacteria into the environment of the toilet.

FIG. 5*a* illustrates an alternative alternating current (AC) power source for unit 10. It may be connected to the unit by a conventional power cord 138 in accordance with building and other applicable codes. It is to be understood that the AC power source may be used to provide electrical power to any of the variants described herein as well as unit 10.

Figure 6:
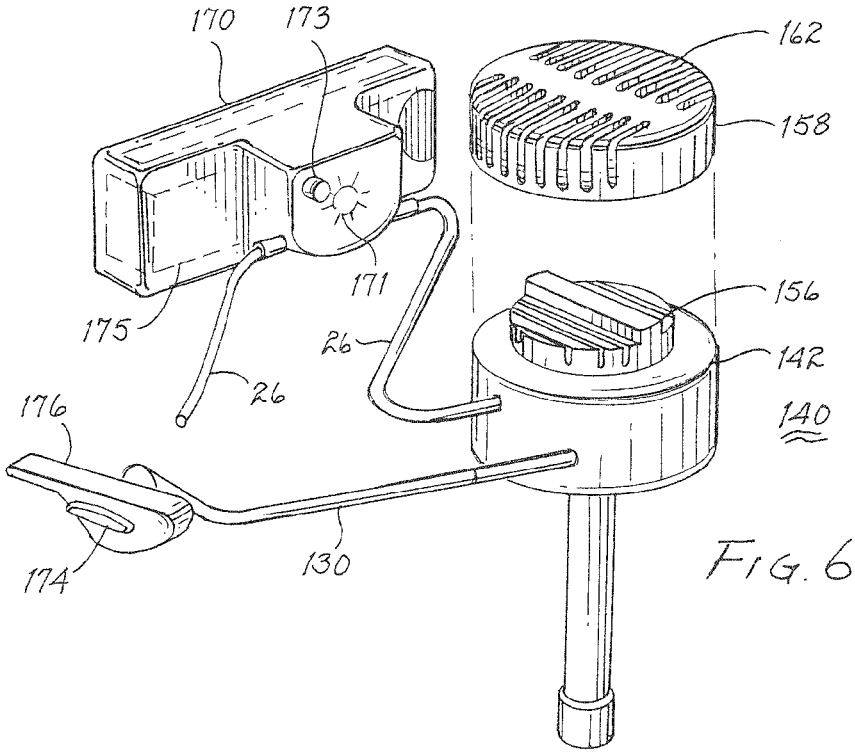
FIG. 6 illustrates the components of a variant of the odor eliminator.
Figure 7:
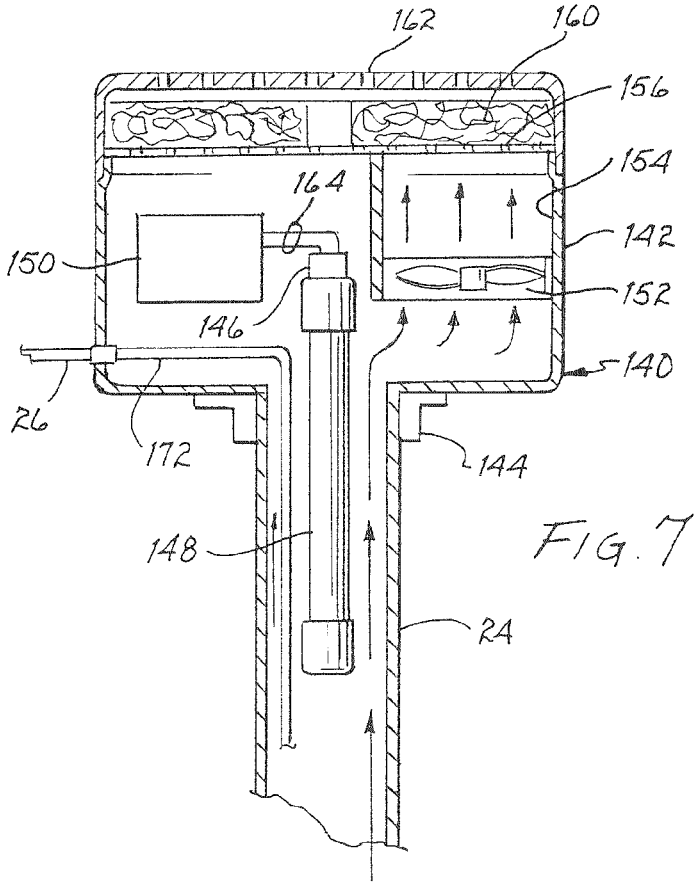
FIG. 7 illustrates a cross sectional view of the variant shown in FIG. 6.

Referring jointly to FIGS. 6 and 7, a variant 140 of unit 10 will be described. Housing 142 of the variant may be cylindrical, as illustrated. A collar 144 is disposed at the bottom of the housing to receive and encircle the top of stand pipe 24. Thereby, the variant is mounted directly on the stand pipe. A fixture 146 mounted in housing 142 supports, in a depending relationship, UV lamp 148. As illustrated, the UV lamp extends into stand pipe 24. A circuit board 150, or the like, provides the necessary electronic circuitry to operate the UV lamp on command. Necessarily, the circuit board is suitably mounted within housing 142. A fan 152 is mounted at the inlet of a channel 154. The upper end of the channel is terminated by a plurality of apertures, such as slots 156. A cap 158 is removably attached to the upper end of housing 142 to contain therein carbon mesh 160, or the like, to assist in purifying the air passing therethrough. The purified air is exhausted through further apertures or slots 162 in the cap. The operation of fan 152 is controlled by electronic circuitry on circuit board 150 via electrical conductors (not shown). Similarly, control of UV lamp 148 is effected by the electronic circuitry on circuit board 150 and conveyed to the UV lamp by electrical conductors 164.

Electrical power to variant 140 may be provided by rechargeable batteries 175 mounted within case 170. These batteries are electrically connected to the electronic circuitry on circuit board 150 via electrical conductors (no shown). Case 170 may be attached to the interior surface of the water tank wall by clips, or the like, engaging the upper edge of the water tank wall. Preferably, batteries 175 within case 170 are rechargeable batteries. Tubing 26, associated with float valve 126, as shown in FIG. 5, is connected to case 170. Water flow through fill tubing 26 will drive an impeller 171 mounted within the case and connected to a generator 172. Upon activation of the generator, a current will be developed which is used to recharge the batteries in the case. Outflow of water from the impeller is conveyed by a further length of fill tubing 26 to housing 142, as shown in FIG. 7. Interior of the housing, there may be tubing or conduit 172 to convey the inflowing water into stand pipe 24, as illustrated.

As described above with respect to unit 10, a switch 174 incorporated with a handle 176 maybe used to energize and de-energize variant 140.

Figure 8:
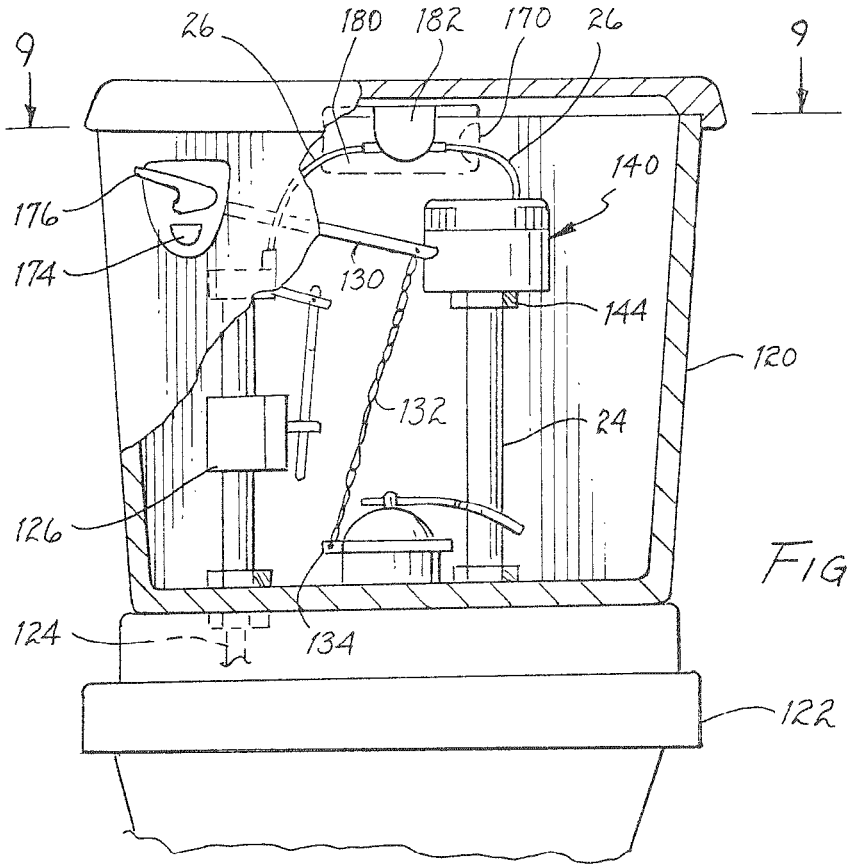
FIG. 8 is a partial cross sectional view of the variant mounted within the water tank of a conventional flush toilet.
Figure 9:
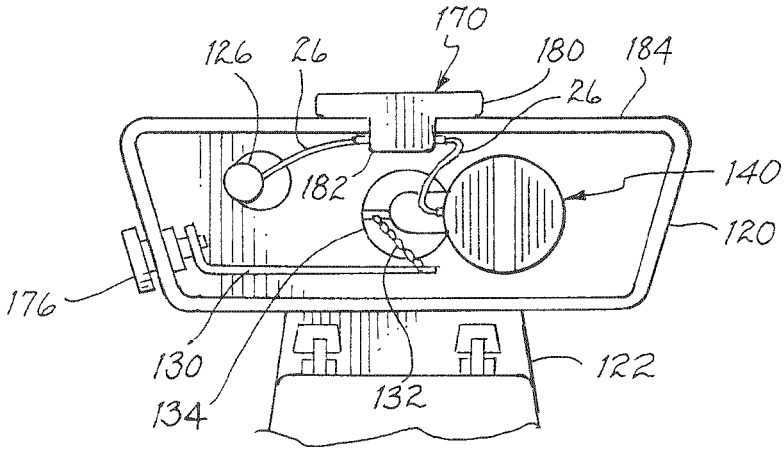
FIG. 9 is a cross sectional view taken along lines 9-9, as shown in FIG. 8.

As shown in FIGS. 8 and 9, variant 140 is supported by stand pipe 24 at its upper end. Case 170 includes a first compartment 180 housing rechargeable batteries. A second compartment 182, housing an impeller and generator is connected to but spaced apart from compartment 180. The space between the two compartments is of sufficient width to receive upper edge 184 of one side of tank 120. Thereby, the source of electrical power for variant 140 may be placed in close proximity to the variant. As discussed above in another embodiment, case 170 containing the batteries and the impeller may be mounted internally within water tank 120 and receive support therefrom by clips or hooks engaging an upper edge of the water tank. In another embodiment, case 170 may simply contain alkaline or non-rechargeable batteries, which would require periodic replacement. With case 170 being detachably mounted at the upper edge of the water tank, the process of replacing the batteries is relatively simple and straight forward.

Figure 10:
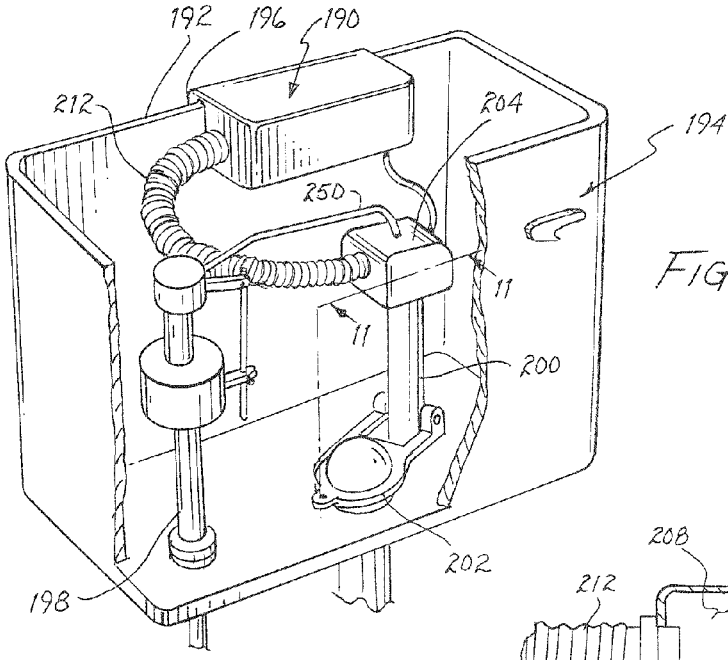
FIG. 10 illustrates a further variant of the odor eliminator mounted in a water tank of a conventional flush toilet.

In recent years, manufacturers of toilet tanks for flush toilets have developed numerous configurations attendant the fill valve and the stand pipe. Accordingly, the odor eliminator described herein is preferably useable in conjunction with any of these embodiments. Referring to FIG. 10, there is shown a self contained odor eliminator hereinafter referred to as unit 190 and adaptable to the various toilet tank configurations presently being marketed. The unit may be supported by top edge 192 of a water tank 194. A lip 196 extending laterally from the top of unit 190 may be used for this purpose to receivingly engage top edge 192. The water tank includes a conventional float valve 198, a conventional stand pipe 200 and a flapper valve 202. As particularly shown in FIG. 11, a coupling 204 includes a collar 206 adapted to circumscribingly engage the top end of stand pipe 200. The coupling includes a closed space 208 for receiving air and gases drawn through stand pipe 200, as representatively illustrated by arrow 210. A flexible hose 212 is attached to wall 214 of the coupling in the conventional manner. This hose serves in the manner of a conduit to channel air and gas from within the coupling, as represented by arrow 216.

Figure 12:
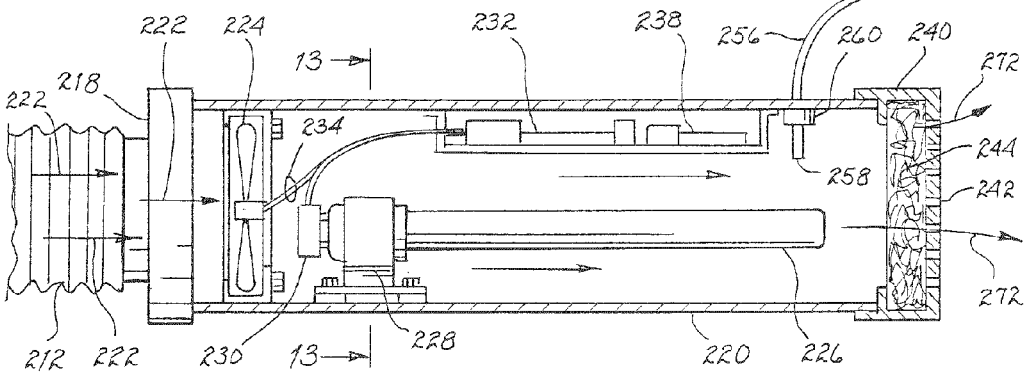
FIG. 12 is a cross sectional view of the further variant of the odor eliminator shown in FIG. 10.

As illustrated in FIG. 12, hose 212 is attached to wall 218 of housing 220 to convey air and gases from coupling 204 into the housing, as representatively illustrated by arrows 222. A fan 224 is mounted within housing 220 proximate wall 218 to draw air and gas from hose 212 into the housing. A UV lamp 226 is supported by a mounting 228 secured to an interior surface of the housing. A plug 230 of the conventional type is used to interconnect the prongs of UV lamp 228 with electronic circuitry mounted on circuit board 232, which circuit board is secured within housing 220. Electrical conductors 234 and 236 interconnect fan 224 and plug 230, respectively, with the components mounted on circuit board 232. Electrical power for the fan and the UV lamp, as well for as the electronic circuitry on the circuit board, may be provided by a battery 238 mounted on or in proximity to circuit board 236 within housing 220.

Not only does fan 224 draw air and gas through hose 212, it also forces the air and the gas past UV lamp 236. During such passage, some of the oxygen molecules will be converted to ozone molecules by the UV radiation impinging thereupon. The ozone molecules will tend to oxidize molecules of organic matter. Additionally, the UV radiation emitted from the UV lamp will serve in the manner of a virucide and germicide. Thereby, most, if not all, odorous gases are destroyed within housing 220. The air and gas flowing past the UV lamp is exhausted through a cap 240 mounted at the end of the housing and incorporating numerous apertures 242. Additionally, a carbon mesh 244 or similar filtering element may be incorporated to further purify the air and gas exhausting from housing 220.

Figure 11:
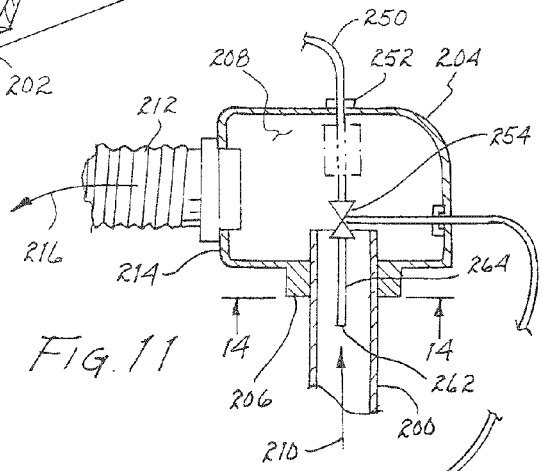
FIG. 11 is a partial cross sectional view taken along lines 11-11, as shown in FIG. 10.

A fill tube 250 is used in the conventional manner to provide a supply of water for washing the sides of the toilet bowl during flushing and filling of the toilet bowl. Water for the fill tube is provided by an outlet attendant float valve 198. In the configuration of the present invention, the fill tube is incorporated with the odor eliminator for the purpose of entraining ozone into the water exhausted from the fill tube and thereby assist in deodorizing the surfaces of the toilet bowl. As shown in FIG. 11, fill tube 250 enters space 208 of coupling 204 through a fitting 252. It is connected to the inlet of a venturi 254. A conduit 256 includes an end 258 disposed within the above ambient pressure environment within housing 220 and is secured by a fitting 260. Because of the above ambient pressure within the housing, ozone enriched air will tend to flow into conduit 256 to venturi 254. Additionally, the flow of water from fill tube 250 through the venturi will create a low pressure environment at the outlet of conduit 256. Thereby, ozone enriched air is drawn into the water flowing through the venturi and discharged into the stand pipe through outlet 262 of a further conduit 264 extending from the venturi.

While venturi 254 and the attendant tubing and conduit for entraining ozone enriched air into the water flowing into the toilet bowl is shown and described with respect to variant 190 (see FIGS. 10, 11 and 12), it is to be understood that these items may be incorporated in unit 10 (FIG. 1) and/or in variant 140 (FIG. 6). Thereby, any of the embodiments of the odor eliminator will have the benefits attendant ozone enriched air entrained in the water flowing into the toilet bowl.

Figure 13:
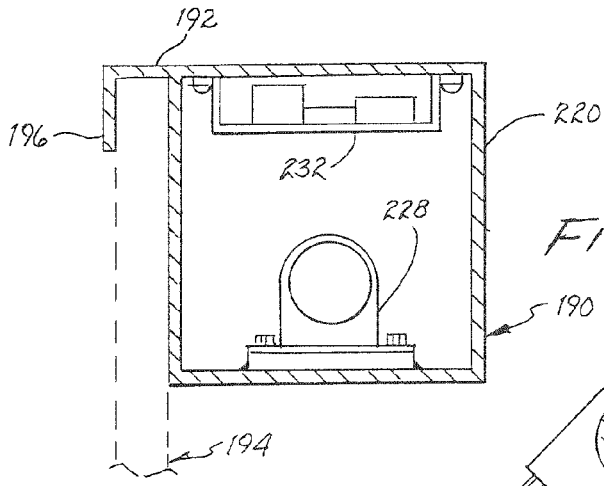
FIG. 13 is a cross sectional view taken along lines 13-13, as shown in FIG. 12.

Referring to FIG. 13, there is illustrated in more detail the support mechanism for unit 190. Housing 220 supports mounting 228 for positionally retaining the UV lamp. Additionally, it supports circuit board 232 along with the components and battery mounted thereon. Housing 220 is readily detachably attachable to a wall of toilet tank 194 by inserting top edge 192 of a wall of the toilet tank in the space defined between housing 220 and lip 196. As housing 220 will rest against the interior surface of the toilet tank supporting wall, it is relatively stable and yet can be easily lifted out and remounted. Moreover, housing 220 will easily fit on any presently known water tank for a conventional flush toilet.

Figure 14:
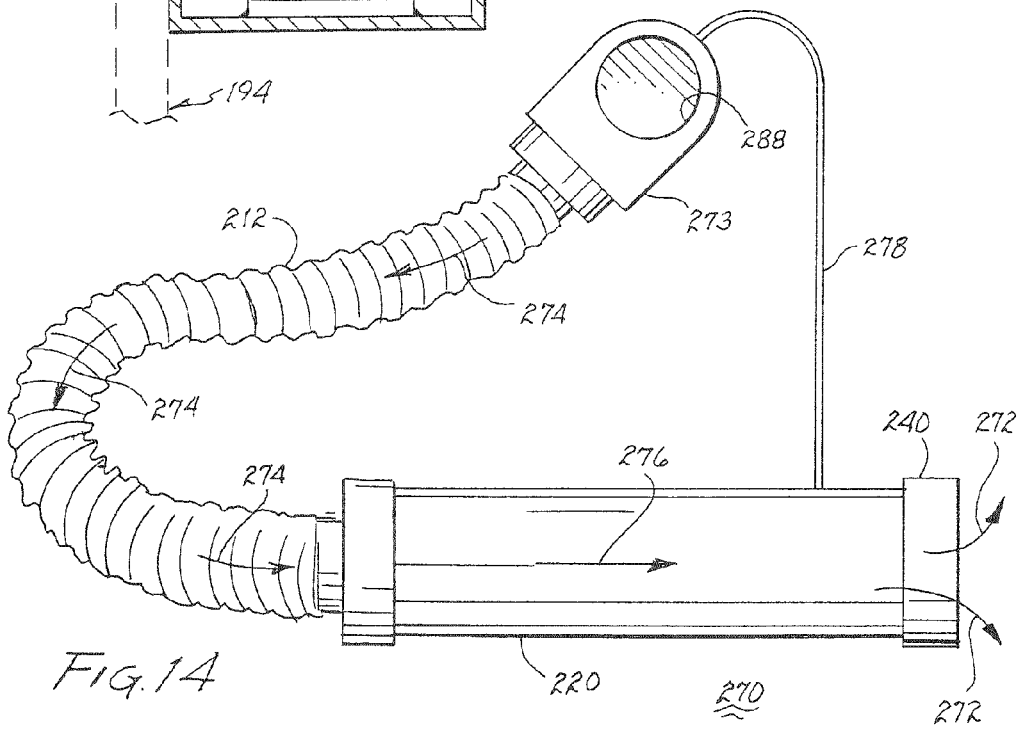
FIG. 14 illustrates a variant stand pipe coupling.
Figure 14A:
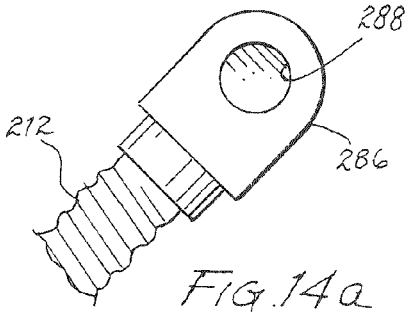
FIGS. 14*a* and 14*b* illustrate further variants of the stand pipe coupling.
Figure 14B:
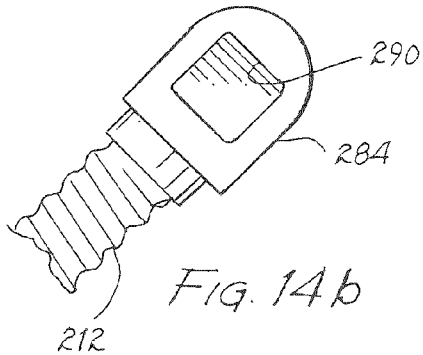

Referring jointly to FIGS. 14, 14*a* and 14*b*, there is shown a variant of unit 190. The variant includes a housing 220 configured and operating in the manner described above. It includes a cap 240 having a plurality of apertures to permit discharge of the irradiated and ozone enriched air, as representatively depicted by arrows 272. A hose 212 conveys air from coupling 273 into housing 220, as representatively illustrated by arrows 274. The inflowing air and gas pass through housing 220, as representatively illustrated by arrow 276. As discussed above, a conduit 278 may extend from the interior of housing 220 into coupling 273 to provide a source of ozone enriched air into the stand pipe or into entrainment with water flowing into the stand pipe from a fill tube. Coupling 273 is configured to operatively mate with a particularly sized and configured upper end of a stand pipe in a water tank. Since such stand pipes may have different configurations as a result of significant changes in the industry, a single coupling may not fit the upper end of all presently existing stand pipes. For this reason, additional couplings 282 and 284, are illustrated in FIGS. 14*a* and 14*b* Each of these couplings may be connected to the end of hose 212 in the conventional manner. As representatively shown in FIG. 14, coupling 273 has a relatively large opening 286 to accommodate stand pipes of significant diameter. Coupling 282 has a relatively small opening 288 to accommodate stand pipes of smaller diameter. Coupling 284 includes a square opening 290 to accommodate a stand pipe square in cross section. It is to be understood that other configurations may be incorporated in the coupling to mate with a correspondingly sized and configured upper end of a stand pipe.

We claim:

1. A toilet bowl odor eliminator mounted within a water tank of a conventional flush toilet having a stand pipe in fluid communication with the toilet bowl, a flapper valve for passing water to the toilet bowl from the water tank and a water fill tube extending from a valve mechanism responsive to the water level in the water tank for filling the tank, said odor eliminator comprising in combination:

a) a housing for accommodating a flow of air therethrough;

b) a UV lamp disposed in said housing for irradiating air and malodorous gases within said housing to kill microorganisms and to convert oxygen molecules into ozone molecules, to oxidize organic matter present in the air and to kill bacteria and viruses that may be present in the air;

c) a receiver for engaging the upper end of the stand pipe to support said odor eliminator upon the stand pipe;

d) a fan for drawing a flow of air from the interior of the stand pipe and urging a flow of air through said housing; and e) a source of electric power for energizing said UV lamp and said fan; and f) an impeller coupled to the water fill tube for activating electrical current flow in the source of electric power in response to water flow through the water fill tube.

2. The toilet bowl odor eliminator as set forth in claim 1 including a carbon cartridge for filtering air exhausted from said housing.

3. The toilet bowl odor eliminator as set forth in claim 1 wherein said source of electric power is a battery.

4. The toilet bowl odor eliminator as set forth in claim 3 wherein said battery is secured to a wall of the toilet tank.

5. The toilet bowl odor eliminator as set forth in claim 1 including a switch for energizing said UV lamp and said fan.

6. The toilet bowl odor eliminator as set forth in claim 1 wherein the fill tube is in fluid communication with the stand pipe through said housing.

7. The toilet bowl odor eliminator as set forth in claim 3 wherein said battery is rechargeable.

8. The toilet bowl odor eliminator as set forth in claim 7 wherein the fill tube is connected to the impeller for activating a generator generating an electrical current to charge said battery in response to the water flow through the fill tube.

9. The toilet bowl odor eliminator as set forth in claim 8 including a further fill tube for conveying water from said impeller to said housing.

10. The toilet bowl odor eliminator as set forth in claim 1 including a venturi in fluid communication with the fill tube for urging water flow through said venturi, an outlet extending from said venturi for injecting water into the stand pipe and a conduit in fluid communication with the interior of said housing and connected to said venturi for drawing ozone enriched air into said venturi and for entrainment with the water flowing through said venturi.

11. The toilet bowl odor eliminator as set forth in claim 1 including a bed of silver ions disposed in the path of water flow to the stand pipe.

12. The toilet bowl odor eliminator as set forth in claim 1 including a bed of metals selected from the group of silver, copper and zinc disposed in the path of water flow to the stand pipe.

13. The toilet bowl odor eliminator as set forth in claim 1 including a reflector disposed in said housing for reflecting the radiation from said UV lamp.

14. A toilet bowl odor eliminator is mounted within a water tank of a conventional flush toilet having a stand pipe in fluid communication with the toilet bowl, a flapper valve for passing water to the toilet bowl from the water tank and a water fill tube extending from a valve responsive to the water level in the water tank for filling the tank, said odor eliminator comprising in combination:

a) a housing in fluid communication with the stand pipe for accommodating a flow of air from the stand pipe through said housing;

b) a UV lamp disposed in said housing for irradiating air flowing through said housing to kill microorganisms and to convert oxygen molecules into ozone molecules and produce ozone enriched air for oxidizing any organic matter than may be present in the air and for destroying bacteria and viruses that may be present in the air;

c) a fan for urging a flow of air from the stand pipe through said housing and exhausting the air from said housing;

d) a filter for filtering the air exhausted from said housing; and e) a source of electric power for energizing said UV lamp and said fan; and f) an impeller coupled to the water fill tube for activating electrical current flow in the source of electric power in response to water flow through the water fill tube.

15. The toilet bowl odor eliminator as set forth in claim 14 wherein said source of electric power is a battery.

16. The toilet bowl odor eliminator as set forth in claim 15 wherein said battery is supported by the water tank.

17. The toilet bowl odor eliminator as set forth in claim 14 wherein said filter is a carbon mesh filter.

18. The toilet bowl odor eliminator as set forth in claim 14 wherein said UV lamp extends into the stand pipe.

19. The toilet bowl odor eliminator as set forth in claim 18 including a collar for interconnecting said housing with the top end of the stand pipe.

20. The toilet bowl odor eliminator as set forth in claim 14 wherein said battery is rechargeable.

21. The toilet bowl odor eliminator as set forth in claim 20 including a case having one compartment for containing said battery and a second compartment for containing said impeller and a generator for charging said battery and wherein the fill tube conveys water to said second compartment and from said second compartment to the stand pipe to operate said impeller.

22. The toilet bowl odor eliminator as set forth in claim 14 including a venturi in fluid communication with the fill tube for urging water flow through said venturi, an outlet extending from said venturi for injecting water into the stand pipe and a conduit in fluid communication with the interior of said housing and connected to said venturi for drawing ozone enriched air into said venturi and for entrainment with the water flowing through said venturi.

23. The toilet bowl odor eliminator as set forth in claim 14 including a bed of silver ions disposed in the path of water flow to the stand pipe.

24. The toilet bowl odor eliminator as set forth in claim 14 including a bed of metals selected from the group of silver, copper and zinc disposed in the path of water flow to the stand pipe.

25. The toilet bowl odor eliminator as set forth in claim 14 including a reflector disposed in said housing for reflecting the radiation from said UV lamp.

26. A method for eliminating odors attendant a conventional flush toilet with an apparatus supported within the water tank of the toilet, which toilet includes a stand pipe in communication with the toilet bowl and a water fill tube, said method comprising the steps of:

a) drawing air with a fan from within the stand pipe into a housing of the odor eliminating apparatus disposed in the water tank;

b) during exercise of said step of drawing, irradiating the air within the housing with UV radiation from a UV lamp to produce a stream of ozone enriched air exhausting from the housing and to serve as a germicide and a virucide;

c) exhausting the air from the housing in response to operation of the fan;

d) controlling the operation of the UV lamp and the fan with electronic circuitry mounted within the housing; and e) providing a source of electric power to the electronic circuitry; and f) providing an impeller coupled to the water fill tube for activating electrical current flow in the source of electric power in response to water flow through the water fill tube.

27. The method as set forth in claim 26, wherein the source of electric power is a battery and including the step of charging the battery in response to the water flow through the fill tube.

28. The method as set forth in claim 27, wherein said step of charging includes the step of rotating said impeller connected to an electric generator in response to the flow of water through the fill tube.

29. The method as set forth in claim 28 wherein the battery is in one compartment of a case and the impeller and generator are in another compartment of the case and wherein there is a space between the first and second compartments and including the step of supporting the case with a top edge of the water tank wall located in the space between the first and second compartments.

30. The method as set forth in claim 26 including the step of filtering the air during exercise of said step of exhausting.

31. The method as set forth in claim 26 including the step of entraining ozone enriched air into the water flowing to the toilet bowl.

32. The method as set forth in claim 26 including the step of channeling water flowing into the toilet bowl through a bed of silver ions.

33. The method as set forth in claim 26 including the step of channeling water flowing into the toilet bowl through a bed of metals selected from the group of silver, copper and zinc.

34. The method as set forth in claim 26 including the step of reflecting the radiation from the UV lamp within the housing.

35. A toilet bowl odor eliminator mounted within a water tank of a conventional flush toilet having a stand pipe in fluid communication with the toilet bowl, a flapper valve for passing water to the toilet bowl from the water tank and a water fill tube extending from a valve mechanism responsive to the water level in the water tank for filling the tank, said odor eliminator comprising in combination:

a) a housing for accommodating a flow of air therethrough;

b) a UV lamp disposed in said housing for irradiating air and malodorous gases within said housing to kill microorganisms and to selectively convert oxygen molecules into ozone molecules, to oxidize organic matter present in the air and to kill bacteria and viruses present in the air;

c) a coupling for engaging the upper end of the stand pipe;

d) a hose for interconnecting said coupling with said housing;

e) a fan for drawing air and gases from the stand pipe, through said coupling, through said hose, into said housing and exhausting the air from said housing; and f) a source of electric power for energizing said UV lamp and said fan; and g) an impeller coupled to the water fill tube for activating electrical current flow in the source of electric power in response to water flow through the water fill tube.

36. The toilet bowl odor eliminator as set forth in claim 35 wherein said hose is a flexible hose.

37. The toilet bowl odor eliminator as set forth in claim 35 including a support for supporting said housing on a wall of the water tank.

38. The toilet bowl odor eliminator as set forth in claim 35 including a fill tube extending into said coupling and terminating at a venturi, a further fill tube extending from said venturi into the stand pipe, a conduit extending from within said housing to said venturi for entraining water flowing through said venturi into the stand pipe with ozone enriched air.

39. The toilet bowl odor eliminator as set forth in claim 35 wherein said source of electric power is a battery.

40. The toilet bowl odor eliminator as set forth in claim 39 wherein said battery is a rechargeable battery and including means for charging said battery.

41. The toilet bowl odor eliminator as set forth in claim 40 wherein said charging means comprises said impeller actuated by the water flow from the water fill tube and a generator connected to said impeller to rotate said generator and generate a charging current for said battery.

42. The toilet bowl odor eliminator as set forth in claim 35 including more than one of said couplings interchangeably connectable to said hose.

43. The toilet bowl odor eliminator as set forth in claim 39 including a circuit board disposed within said housing for supporting electronic components and said battery for controlling operation of said fan and said UV lamp.

44. The toilet bowl odor eliminator as set forth in claim 35 including a venturi in fluid communication with the fill tube for urging water flow through said venturi, an outlet extending from said venturi for injecting water into the stand pipe and a conduit in fluid communication with the interior of said housing and connected to said venturi for drawing ozone enriched air into said venturi and for entrainment with the water flowing through said venturi.

45. The toilet bowl odor eliminator as set forth in claim 35 including a bed of silver ions disposed in the path of water flow to the stand pipe.

46. The toilet bowl odor eliminator as set forth in claim 35 including a bed of metals selected from the group of silver, copper and zinc disposed in the path of water flow to the stand pipe.

47. The toilet bowl odor eliminator as set forth in claim 35 including a reflector disposed in said housing for reflecting the radiation from said UV lamp.

* * * * *